US005527600A

United States Patent [19]

Frankosky et al.

[11] Patent Number: 5,527,600

[45] Date of Patent: Jun. 18, 1996

[54] BONDED POLYESTER FIBERFILL BATTINGS WITH A SEALED OUTER SURFACE

[75] Inventors: Michael S. Frankosky; Wo K. Kwok, both of Hockessin, Del.

[73] Assignee: E. I. Du Pont de Nemours and Company, Wilmington, Del.

[21] Appl. No.: 396,291

[22] Filed: Feb. 28, 1995

Related U.S. Application Data

[63] Continuation-in-part of Ser. No. 84,936, Jul. 1, 1993, abandoned, which is a continuation-in-part of Ser. No. 800,177, Nov. 27, 1991, Pat. No. 5,225,242.

[51] Int. Cl.[6] ..... B32B 27/00

[52] U.S. Cl. ..... 428/286; 428/290

[58] Field of Search ..... 428/286, 290

[56] References Cited

U.S. PATENT DOCUMENTS

| | | | |
|---|---|---|---|
| 2,326,605 | 8/1943 | Bass et al. | 427/366 |
| 2,454,391 | 11/1948 | Jones et al. | 427/366 |
| 3,963,820 | 6/1976 | Blakey | 264/134 |
| 4,551,383 | 11/1985 | Sinischalchi | 428/286 |
| 4,869,771 | 9/1989 | LeVan | 156/289 |

FOREIGN PATENT DOCUMENTS

| | | | |
|---|---|---|---|
| A0265221A1 | 10/1987 | European Pat. Off. | D04H 1/42 |
| A0314433 | 10/1988 | European Pat. Off. | D04H 1/42 |
| A0437268A1 | 1/1991 | European Pat. Off. | D04H 1/64 |
| WO80/01031 | 2/1980 | WIPO . | |
| WO93/11292 | 11/1992 | WIPO | D04H 1/64 |

*Primary Examiner*—Christopher W. Raimund

[57] ABSTRACT

Improved polyester fiberfill batts for apparel and other uses are prepared of polyester fiber and binder fiber, sprayed with a soft resin by oven bonding and hot roll treatment. This provides bonded batting which is characterized by softness and drapability, good insulating performance, low levels of fiber leakage or percolation through shell fabrics, enhanced durability when laundered by washing/drying or by dry cleaning, and enhanced structural integrity whereby it hangs freely without the need for quilting into small size panels.

8 Claims, No Drawings

BONDED POLYESTER FIBERFILL BATTINGS WITH A SEALED OUTER SURFACE

CROSS-REFERENCE TO RELATED APPLICATION

This application is a continuation-in-part of application Ser. No. 08/084,936, which is being abandoned in favor of the present application, and which was filed Jul. 1, 1993, as a continuation-in-part of application Ser. No. 07/800,177 filed by Frankosky et al Nov. 27, 1991, and now issued as U.S. Pat. No. 5,225,242 on Jul. 6, 1993.

FIELD OF THE INVENTION

This invention is concerned with improvements in and relating to bonded polyester fiberfill batts, sometimes referred to as battings, especially processes whereby such improved batts with desirable aesthetic and serviceable qualities may be obtained, and to articles incorporating such improved batts.

BACKGROUND OF THE INVENTION

Polyester fiberfill (sometimes referred to as polyester fiberfilling material) is well accepted as a reasonably inexpensive filling and/or insulating material for pillows, cushions and other furnishing materials, including bedding materials, and in apparel, and is manufactured and used in large quantities commercially. For many of these uses, as disclosed, e.g., in U.S. Patents: Tolliver U.S. Pat. No. 3,772,137; Stanistreet U.S. Pat. No. 4,068,036; Scott U.S. Pat. No. 4,129,675; Pamm U.S. Pat. No. 4,281,042; Frankosky U.S. Pat. No. 4,304,817; Siniscalchi U.S. Pat. No. 4,551,383; and LeVan U.S. Pat. No. 4,869,771, it has been desirable to make bonded batts, e.g., by spraying a resin-bonding agent, usually of an acrylic polymer, or by blending the polyester fiberfill with binder fibers, such as are well known in the art, or by use of both a resin-bonding agent and binder fibers.

To improve the aesthetics of polyester fiberfill, it has often proved desirable to "slicken" the fiberfill with a coating of durable (i.e., wash-resistant) coating that has usually been a silicone, i.e., a cured polysiloxane as disclosed, e.g., by Hofmann U.S. Pat. No. 3,271,189; Mead et al U.S. Pat. No. 3,454,422; Ryan U.S. Pat. No. 3,488,217; Salamon et al U. S. Pat. 4,146,674; LeVan, above; Takemoto Oil and Fat Co., Ltd., Japanese Published Application No. 58-214,585(1983); or other types such as the polyalkylene oxide variety disclosed by, e.g., Marcus U.S. Pat. No. 4,818,599.

Despite all the prior suggestions and commercially-available materials, especially for use in premium level apparel products, sleeping bags, and comforters, there still remains a need for an easily prepared, homogeneous batting that is characterized by softness and drapability to conform to the wearer's body, good insulating performance, low levels of fiber leakage through shell fabrics, even after laundering, enhanced durability to laundering by washing/drying or by dry cleaning, and enhanced structural integrity whereby the batting is able to hang freely without the need for having it quilted into small size panels.

SUMMARY OF THE INVENTION

According to one aspect of the invention, there is provided a process for preparing a bonded batt, comprising forming a blend of polyester fiberfill, in amount by weight about 70 to about 96%, intimately mixed with a binder fiber, preferably a bicomponent binder fiber, having binder material of melting point lower than the softening point of the polyester fiberfill, in amount by weight about 4 to about 30%, preparing a continuous batt from said blend, said batt having an upper face and a lower face, advancing said batt through one or more spray zones, whereby both faces of the batt are sprayed with resin, in total amount about 10 to about 30% of the weight of the sprayed batt, including the resin, said resin being selected to provide, after curing, a cured resin having a glass transition temperature (Tg) of about 0 degrees Celsius or less, heating the sprayed batt in an oven to cure the resin and soften the binder material, followed by hot-rolling the heated batt to achieve intimate contact between the resin and the fibers in the faces of the batt, and cooling the rolled batt.

Such hot-rolling for this aspect of the invention is preferably effected by use of heated rolls in a calender or S-wrap configuration. The weight of the fibers in the batt (i.e., of the blend of polyester fiberfill and of binder fiber) is referred to as the "basis weight" of the batt, i.e., before the sealing resin is sprayed on.

Another aspect of the invention accordingly provides a bonded batt, comprising primarily polyester fiberfill of 0.2 to 10 dtex per filament (in amount about 75 to about 98%), bonded throughout with lower melting binder material (from the binder fiber used in the process) in complemental amount by weight about 2 to about 25% of the weight of the batt, and with upper and lower faces of said batt being sealed with a resin having a glass transition temperature (Tg) of about 0 degrees Celsius or less, and preferably from about 0 degrees down to about −30 degrees Celsius, in amount about 10 to about 30% of the weight of the batt, whereby the sealing rating (SR, as defined) of said faces is at least 3, said batt having a wash durability (WD, as defined) of at least 3, and a bending stiffness (B, as defined) of about 80 $cN/cm^2$ or less, preferably about 50 $cN/cm^2$ or less.

In addition to such bonded batts, that are sealed with resin on both faces, such as are generally preferred, there are also provided, according to another aspect, similar batts that are sealed on only one face, and containing half such amount of resin. Accordingly, there is provided a bonded batt with upper and lower faces, said batt comprising polyester fiberfill of 0.2 to 10 dtex per filament, in amount about 75 to about 98%, and bonded throughout with lower melting binder material, complementally in amount about 2 to about 25%, said amounts being calculated on the basis weight of the batt, said batt having a wash durability (WD, as defined) of at least 3, and a bending stiffness (B, as defined) of about 80 $cN/cm^2$ or less, wherein at least one of said faces is sealed with a resin having a glass transition temperature (Tg) of about 0 degrees Celsius or less, and preferably from about 0 degrees down to about −30 degrees Celsius, in amount about 5 to about 15% of the total weight of the batt, whereby the sealing rating (SR, as defined) of said face is at least 3.

According to a further aspect, hot rolling need not necessarily be performed to impart adequate sealing, by using low denier fiberfill (referred to variously as subdenier or microfibers) at least in one or both face(s) of the batt. Thus, there is provided a bonded batt, with upper and lower faces, said batt comprising polyester fiberfill of denier per filament about 1 or less, in amount about 75 to about 96% and bonded throughout with lower melting binder material, complementally in amount about 4 to 25%, said amounts being calculated on the basis weight of the batt, said batt having a wash durability (WD, as defined) of at least 4, and a bending stiffness (B, as defined) of about 40 $cN/cm^2$ or less, wherein at least one of said faces is sealed with a resin having a glass transition temperature (Tg) of about 0 deg Celsius or less, and preferably from about 0 degrees down to about −30 degrees Celsius, in amount about 0.02 to about 0.35 oz/yd$^2$, preferably about 0.1 to about 0.25 oz/yd$^2$, calculated with regard to said face of the batt, whereby the sealing rating (SR, as defined) of said face is at least 4. Preferably each of said faces is so sealed.

Both metric units, such as dtex and denier are used herein, 1 dtex being the same as 0.9 denier per filament (dpf).

DETAILED DESCRIPTION OF THE INVENTION

Thus, the invention provides fiberfill batts, such as are needed for use in premium apparel, by first preparing a homogeneous blend of polyester fiberfill (70–96% by weight of the blend) and a suitable binder fiber(4–30% by weight of the blend). This blend is converted on a card or garnet to a web which may then be layered or cross lapped to form a batting to whose upper (and preferably serially also to whose lower) face is applied a suitable latex (e.g., a colloidal dispersion of acrylic polymers and/or copolymers in water, discussed in more detail hereinafter), e.g., by spraying. The sprayed batting is heated, e.g., conveniently by being passed through a heated oven to dry the coating(s) and to polymerize the polymeric component(s) to high molecular weight, and to activate the binder fiber. This may be conveniently done, for example, in three passes through such an oven, two to serially dry and partially cure each such coating, after it has been applied to any face, and a final pass to supplement the other(s) and to ensure activation of the binder fiber in preparation for any hot-rolling, in which the bonded batt is passed around or through heated rolls (S-wrap or calendering process) to soften and spread the cured resin and ensure its complete and even distribution among the fibers in the face(s) (large surfaces) of the batt to prevent fiber leakage through such surface(s) of the batt and, if needed, to ensure that the batt is of the desired thickness.

When the fiberfill is of 0.2 to 1 denier per filament, and said resin applied to the batting faces has a glass transition temperature (Tg) of about 0 degrees Celsius and has been applied in amounts between about 0.02 oz/yd$^2$ (0.7 g/m$^2$) to 0.35 oz/yd$^2$ (12 g/m$^2$), then additional treatment, as with hot rolls, is not needed to prevent fiber leakage, especially when dry fiberfill is used. Hot roll treatment may be applied to ensure that the batt is of the desired thickness and to reduce bending stiffness.

The resins that may be used herein are termed variously, by different manufacturers, as "soft" or "medium", or even "very soft", but are characterized by having second order glass transition temperatures (Tg) of about °C. or less, and preferably from about 0 degrees down to about −30 degrees Celsius. They provide both softness and drapability to the batt when used in, e.g., apparel, while acting as barrier to fiber leakage from the batt. The final batts may have a basis weight of 1.5 to 12 oz/yd$^2$ (50 to 400 g/m$^2$) and a thickness of 0.07 to 0.20 inch/oz/yd$^2$(0.05 to 0.15 mm/g/m$^2$). Thus the batts of this invention are prepared from a blend of polyester fiberfill and binder fibers, and the fibers in the face(s) are sealed by a suitably soft-type resin coating. The polyester fiberfill may all be slickened, e.g., as described herein, or may be a blend of slickened and unslickened fibers. The fiberfill may be solid, hollow, or a blend of solid and hollow fibers and is not limited to any type of fiber cross section, i.e., it may be of cruciform, trilobal, Y-shaped, dog bone, scalloped oval, and other non-circular cross sections as well as round. The fiberfill has a denier per filament (dpf) within the range of 0.2 to 10, with a dpf of about 1.65 being very useful, and constitutes about 70 to 96% by weight of the blend. As indicated, subdenier fibers give good sealing in the face(s) of the bonded batt, so are often preferred in such face(s). The individual fibers are provided with crimp by conventional means and typically exhibit from 5 to 15 crimps per inch (cpi) and have a length within the range of ¾ to 3 inches. The binder fibers constitute from about 4 to 30% by weight of the batt and may be of the sheath/core (s/c), side/side (s/s), or monocomponent types. These may be obtained from (co)polyesters, polyolefins, polyolefin/polyester, polyamide/polyamide, e.g., and the like. Useful types of binder fibers, and their modes of functioning, are described in, e.g., "Nonwovens World", March/April, 1990, page 37. The initial dpf of suitable binder fibers in the blend is typically within the range of 2 to 15 with a dpf of 4 being commonly used. Useful binder fibers include those disclosed in the aforementioned U.S. Patents to Scott, Pamm, Frankosky, and Marcus, together with those shown in Harris et al U.S. Pat. No. 4,732,809; Taniguchi et al U.S. Pat. No. 4,789,592; Tomioka et al U.S. Pat. No. 4,500,384; Hirose et al Japanese Patent Publication Kokai 57-210,015 (1982); and others known in the art which will function within the oven temperatures disclosed herein. Preferred binder fibers include the commercially-available "Melty 4080" (Unitika Co., Japan) and the "ES" and "EA" polyolefins (Chisso Corporation, Japan).

The cured resin coatings on both faces Of the batt may conveniently constitute about 10 to 30% by weight of the final bonded batt, with 12 to 25% being preferred for 1.65 dpf (1.83 dtex), where lesser amounts of resin tend to reduce wash durability and sealing rating while greater amounts tend to increase stiffness and reduce insulating efficiency. If only one face of the batt is so sealed, only half as much resin need be applied. When low fiber deniers (about 1 dpf or less) are used, less resin coating is needed to achieve fiber leakage control. Moreover, the amount of resin in the surface(s) need not depend on the basis weight of the batting, and so, for heavier battings, the total resin add-on may be as little as 3%, even for slickened fiberfill batts. For entirely dry (unslickened) fibers, less resin is needed than when slickened fiberfill is used.

As noted previously, a suitable sealing resin has a Tg of about 0° C. or less. The useful resins are obtained from commercially-available acrylic and vinyl latex compositions among which are included, e.g., Rhoplex E-32 (Rohm and Haas Co.), TR-934 (Rohm and Haas Co.), X-4280J (Kanebo, Japan), these Hycar® latex compositions of B. F. Goodrich Co.: 26146, 26171, 26322, 26083, 26092, 2671, 26120, 2679, 26796, these latex products of National Starch and Chemical Corporation: NACRYLIC X 4445, NACRYLIC X 788-6007, NACRYLIC X 4483, NACRYLIC X 4460, NACRYLIC X 4260, NACRYLIC X 4425, NACRYLIC X 4465, NACRYLIC 4401, NACRYLIC X 78-3990, NACRYLIC X 78-3997, NACRYLIC X 78-3905, NACRYLIC X 4280, NACRYLIC 4441, NACRYLIC 78-6114, X-LINK 2873, X-LINK 2849, X-LINK 78-6119, X-LINK 2893, X-LINK 2833, X-LINK 78-6004, X-LINK 2813, RESYN 2375, DUR-O-SET E-230, DUR-O-SET E-669, and other commercially-available latexes which are cured to resins whose Tg values are about 0° C. or less. Some of such commercially-available resins and their Tg values are listed in brochures, e.g., one by B. F. Goodrich, dated 1989, entitled HYCAR® Acrylic Latexes, and one by National Starch and Chemical Corporation, entitled Binders, Saturants, Laminants. As the Tg of a sealing resin gets much lower (than 0° C.), such resins tend to become more sticky. Although such resins can provide good sealing for the surface(s) of the batting, and good wash durability, stickiness of a sealing resin can cause sewing problems, which can require slower sewing speeds, which is not generally preferred. So, the Tg of a sealing resin for use according to the present invention is preferably from about 0° to about −30° C.

Preparation of the batts is generally begun by conventional opening and blending of the polyester fiberfill and binder fiber, followed by carding or garnetting to make a Web. This web can be layered with other webs from a train of cards or garnets, or it can be cross lapped and combined with other webs to form an unbonded batting. This batting is then sprayed with the latex composition on one or both sides of the batting and is fed to the oven for curing of the resin and bonding of the binder fibers. The oven treatment is conducted at 150°–190° C. for 2 to 5 minutes, and may be conveniently done in three passes of the batt, as previously noted. The bonded batt is then passed through/around (preferably at least two) hot rolls having a surface temperature in the range of 150° to 250° C. (more than two rolls may be used). The configuration of the batting may be in S-wrap over the rolls to provide maximum contact with the rolls. The latter may have a clearance of from 2 to 5 mm. depending on the final batting thickness desired. Alternatively, the bonded batting may be passed through calender rolls, heated as above. In these treatments, only one roll may be heated, if desired, even to seal both sides of the batt, which may be passed through/over the rolls a second time to heat the opposite side of the batt, if it is desired to seal both faces. Contact time on the rolls is from 3 to 25 seconds. Such hot roll treatment softens and spreads the resin to ensure its complete and even distribution on the batt surface(s) to prevent fiber leakage and to provide a uniform surface, free of lumps, for comfort and aesthetic performance in use. The batts exhibit the basis weight and thickness ranges previously indicated.

The batts of this invention exhibit desirable levels of thermal resistance or insulation, commonly reported as CLO ratings (see Hwang U.S. Pat. No. 4,514,455). Batts of this invention desirably exhibit a CLO value of at least about 0.36 CLO/oz/yd$^2$ and preferably 0.48 CLO/oz/yd$^2$ or higher.

It is to be understood that the components and processes described herein should be selected to provide the batts of this invention. Care must be taken to select combinations that do so provide. For example, the slickener on the fiber and the latex applied to the batt should be selected so as to adhere sufficiently, so that the final batt may exhibit, for example, sufficient wash durability.

TEST PROCEDURES

CLO ratings are obtained as described in Hwang, above.

Wash durability ratings ("WD") of the batts of this invention and of comparisons are evaluated by the procedures of ASTM D-4770-88, the panels being 24 inches×24 inches in size, and are reported for measurements made according to paragraph 8.6.1. Batts of the invention exhibit a rating of 3 or higher (paragraph 8.5 scale).

Fiber leakage or percolation through shell fabric is measured as a sealing rating ("SR") by the method described in LeVan U.S. Pat. No. 4,869,771 (after 3 wash cycles unless indicated otherwise), a sealing rating (SR) of 5 being excellent and a sealing rating (SR) of 1 being poor. The batts of this invention exhibit a sealing rating (SR) of 3 or higher (after 3 wash cycles). In Tables 1 and 3, sealing values are additionally reported after one wash (1 W) as well as after 3 washes (3 W) and compared with initial values before any washing (NEW).

The softness or drapability of the batts of this invention is measured according to German Industrial Standard 53362 Cantilever (DIN 53362 Cantilever) which determines and totals the bending stiffness ("B") of the batting in machine and cross machine directions; the combined results are related to drapability and softness. Batting Test specimens are cut for these measurements to 25 cm. length and 2.5 cm. width, and Test specimens are cut for these measurements in both machine (MD) and cross machine (XD) directions. Each Test specimen is weighed and its weight recorded as "W". Bend length ("LU") is then determined by sliding the Test specimen horizontally on a platform until the front of the bent Test specimen reaches an angle of 41 degrees and 30 seconds. The following calculation is then made:

$B=F_1(LU\div 2)^3$ where B=bending stiffness in cN/cm.$^2$

LU=bend length in cm.

$F_1=9.8\ (W\div L)$

W=weight of the specimen sample in grams

L=sample specimen length in cm.

The batts of this invention exhibit a bending stiffness ("B" being the sum of values determined for MD and XD samples from the batt) of 80 cN/cm.$^2$ or less, a lower bending stiffness being preferred.

The invention is further illustrated in the following Examples, all parts and percentages being by weight, unless otherwise indicated, calculated with regard to the "BW" (Basis Weight, i.e., to the amount of polyester filberfill and binder fiber only, (i.e., without the added resin sprayed onto the faces to improve the sealing).

EXAMPLES

Example 1

An 82 lb. sample of polyester staple containing 50 weight percent silicon-slickened fiber of 1.65 dpf (1.83 dtex) and 2 inch cut length and 50 weight percent dry (no slickener) fiber of the same denier and cut length was opened by a conventional mechanical opener and fed to a hopper. In a separate opener was placed 18 lb. of "Melty 4080" binder fiber (4 dpf, 2 inch cut length, 50/50 s/c) which had been preopened. The binder fiber was fed to the same hopper containing the staple blend and the fibers were mixed, first by hand, then by mechanical tumbling of the combined actions of the inclined and horizontal aprons.

The mixed fibers were fed to two separate garnets which each produced a continuous web about 60 inches wide and having a basis weight of about 1 oz./yd.$^2$ (34 g/m.$^2$). Each web was passed through a separate cross lapper which produced a cross lapped batt which was placed on a moving conveyor whose speed was about 8 yd./min (7.3 m./min.). The conveyor collected and combined both cross lapped batts into a final multiple-layered batt having a basis weight of about 2.7 oz./yd.$^2$ (90 g./m.$^2$). In a continuous operation, this batt was passed into a spray zone where Kanebo's X-4280J latex (Tg of −4° C.) was applied to the top side of the batt which was then passed into a 3-path oven (sufficient latex was applied to provide 9% by weight cured resin on the batt). This path was at 150° C. and the resin was cured and the binder fiber activated during a residence time of about 1 minute in the oven. After the batt exited the oven, it was inverted, latex applied to the top side ("new") of the batt, and the batt was carried by a second conveyor to a second path of the oven (170° C.) to cure the resin and activate the binder fiber (resin at 9% by weight resulted on this side of the batt to make a total of 18% by weight resin on the batt). The batting was fed to the third path of the oven (170° C.) to provide further heating of the batt for an additional minute (total heating is for 3 minutes).

The bonded batt is passed through a pair of hot rolls in S-wrap configuration (roll surfaces at 200° C.), with a roll contact time of about 12 seconds; roll separation was 2 mm. The batting is compressesd to about one half its original thickness and is wound up into a roll. This batting (18% resin, 18% binder fiber) had a basis weight of 3 33 oz/yd$^2$, a thickness of 0.41 inch, exhibited a wash durability (WD) rating of 4, a sealing rating (SR) of 5, and total bending stiffness (B) of 22.1 cN/cm.$^2$ (MD=8.6, XD=13.5).

COMPARATIVE DATA

The following comparisons were carried out to show the unexpected benefit according to the present invention, comparing the effect of using, as sealing resin, one with a Tg of less than about 0° C. (Kanebo's X-4280J, Tg of –4° C.) being compared with the acrylic polymer resin-bonding agent (TR-407, available commercially from Rohm and Haas) used by LeVan in his Example in U.S. Pat. No. 4,869,771 (col. 3, lines 38–39), and having a Tg listed as 34° C.

The fiber used for, the comparative data was a blend of 55% 5.5 denier×2.5 inch slick, 27% 1.65 denier×2.5 inch slick, and 18% 4 denier×2.5 inch "Melty 4080" binder fiber. The process used to make the batting was the same as in Example 1, except that the "Melty 4080" binder fibers had already been combined with the fiberfill, as in Example 2, hereinafter. The blended fibers were opened and were fed to two separate garnets which each produced a continuous web about 60 inch wide and having a basis weight of about 1 oz/yd$^2$ (34 g/m$^2$). Each web was passed through a separate cross-lapper which produced a cross-lapped batt which was placed on a moving conveyor whose speed was about 8 yd/min (7.3 m/min). The conveyor collected and combined both cross-lapped batts into a final multiple-layered batt having a basis weight of 3.7 oz/yd$^2$) (123 g/m$^2$). In a continuous operation, this batt was passed into a spray zone where latex (Kanebo X-4280J for "INV", and R&H TR-407 for "COMP") was applied to the top side of the batt which was then passed into a 3-path oven (sufficient latex was applied to provide 9% by weight cured resin on the batt). This path was at 150° C. and the resin was cured and the binder fiber activated during a residence time of about 1 minute in the oven. After the batt exited the oven, it was inverted, latex applied to the top side (new) of the batt, and the batt was carried by a second conveyor to a second path of the oven (170° C.) to cure the resin and activate the binder fiber (resin at 9% by weight resulted on this side of the batt to make a total of 18% by weight resin on the batt). The batting was fed to the third path,of the oven (170° C.) to provide further heating of the batt for an additional minute (total of heating times was about 3 minutes).

The bonded batt was passed through (for INV and COMP A), or by-passed (for COMP B), a pair of hot rolls in s-wrap configuration (roll surfaces at 200° C.) with a roll contact time of about 12 seconds; roll separation was 3 mm. The batting was compressed to about one half its original thickness and wound up into a roll. These battings had a basis weight of 4.5 oz/yd$^2$) (150 g/m$^2$), a thickness of 0.76 inch (1.93 cm) without "hot roll", and a thickness of 0.59 inch (1.5 cm) with "hot roll". The sealing rates (SR) are listed in Table 1.

TABLE 1

| ITEM NO. | TG (°C.) | HOT ROLL | SEALING RATINGS (SR) NEW | 1 W | 3 W |
|---|---|---|---|---|---|
| INV | –4 | Yes | 5 | 5 | 5 |
| COMP A | +34 | Yes | 5 | 5 | 3 |
| COMP B | +34 | No | 5 | 3 | 2 |

Table 1 shows that the Sealing Ratings (SR) for all 3 batts were initially 5, i.e., excellent, and that the SR for the batt of the invention (INV) remained excellent, at 5, even after 3 wash cycles, but that neither of the other batts (COMP A and COMP B, using TR-407, selected by LeVan) had SR values of 5 after 3 wash cycles.

This improvement obtained for batts of invention was not expected.

Example 2

In Table 2 are reported the properties of other batts of the invention, prepared by the apparatus and processes described in Example 1, above, using the same latex (Tg of –4° C.), oven and roll temperatures and times as in Example 1. In the Table, "Fiber A" is the fiber blend of Example 1. In all other indicated "Fibers" ("B", etc.), the binder fiber ("Melty 4080") had already been combined with the fiberfill and was not separately added as shown in Example 1. Fiber B is a 78/22 blend of (1) 5 dtex, solid, round cross-section, 50 mm cut length, polyethylene terephthalate staple bearing a polyalkylene oxide slickener and (2) "Melty 4080" (4 dpf); Fiber C is a 78/7/15 blend of (1) solid, round cross-section, silicone-slickened, 3 dpf polyethylene terephthalate staple, (2) 7-hole hollow round cross-section, silicone-slickened, 5.5 dpf polyethylene terephthalate staple, and (3) "Melty 4080" (4 dpf); and Fiber D is a 75/25 blend of (1) 1.65 dpf solid, round cross-section, silicone-slickened, 2 inch cut length polyethylene terephthalate staple and (2) "Melty 4080" (4 dpf).

TABLE 2

| ITEM NO. | BATTING FIBER | % BINDER | % RESIN | BASIS WEIGHT (OZ/YD$^2$) | THICKNESS (INCHES) | WD | SR | B MD | CD | TOTAL |
|---|---|---|---|---|---|---|---|---|---|---|
| 1 | A | 18 | 25 | 3.14 | 0.41 | 4 | 5 | 33.5 | 35.6 | 69.1 |
| 2 | A | 25 | 18 | 2.86 | 0.35 | 4 | 5 | 20.1 | 31.1 | 51.2 |
| 3 | B | 22 | 12 | 2.76 | 0.35 | 4 | 5 | 23.1 | 38.1 | 61.2 |

TABLE 2-continued

| ITEM NO. | BATTING FIBER | % BINDER | % RESIN | BASIS WEIGHT (OZ/YD²) | THICKNESS (INCHES) | WD | SR | B MD | CD | TOTAL |
|---|---|---|---|---|---|---|---|---|---|---|
| 4 | C | 15 | 18 | 3.24 | 0.31 | 5 | 5 | 14.9 | 18.8 | 33.7 |
| 5 | D | 25 | 18 | 3.08 | 0.33 | 4 | 5 | 13.2 | 34.6 | 47.8 |

Example 3

Various batting samples were prepared and tested, with results being shown in Table 3. The binder fiber each time was "Melty 4080" (4 dpf), but different fiberfill fibers were used.

Samples A, B, C and D in this Example 3 were prepared from a commercially-available blend of polyester fibers consisting of 37.5% of slickened 1.65 dpf (finished with a silicone slickener), 37.5% of dry 1.65 dpf (without any silicone slickener), and 25% binder fiber. The blend was processed on conventional card and cross-lapper equipment similar to the equipment as described in Example 1. The resulting battings were fed through a triple-pass oven maintained at about 165° C. The battings (except for A) were sprayed with equivalent amounts of a soft resin (glass transition temperature (Tg) equals −10 deg C.) on each side such that the total resin add-on was as stated in Table 3, based on "BW" the basis weight of the fiber in the batting at this stage which was about 4.5 oz/yd² (150 g/m²). One side of the batting was sprayed with resin before entering the first pass and the other side was sprayed before entering the second pass. Importantly, the entire batting was exposed to adequate time at a temperature sufficiently high to assure complete cure of the resin and set of the binder fiber (1 minute after the batt has reached 165° C. has generally been sufficient). The battings were then calendered in a separate operation which served to seal the surfaces and reduce loft.

From the Sealing Values in Table 3, it can be seen that, under these conditions, even with 8% resin (Sample B), the effect of calendering did not improve the sealing of the 1.65 dpf fibers batt after 1 wash cycle, and even with 15% resin (Sample C), the sealing was improved after 1 wash cycle, but still inadequate after 3 cycles. At 25% resin, under these conditions, the Sealing Rating of the surface of Sample D was satisfactory (after three wash cycles).

The battings were also tested for fiber leakage by encasing in a fabric with a yarn count of 104×84, and a Frazier air permeability rating of 13.2 cu ft/min at pressure drop of 0.5 inches of water.

Samples E and F were the same as Samples A and D, respectively, except these were tested in a fabric with a yarn count of 102×84 and a Frazier rating of 48. Since 0.7 dpf battings were also tested in a more permeable fabric than for Samples A–D, results on Samples E and F (1.65 dpf) are included in Table 3 to bridge the data between Samples A–D and G–Q. Sample E, without resin, failed when new because of the openness of the fabric, but after three wash cycles had become sufficiently matted that it improved its leakage performance. Sample F's Sealing Value was 5 initially and provided a satisfactory Sealing Rating, i.e., after 3 wash cycles).

Samples G, H, I and J were prepared from a blend of about 85 pounds of dry polyester fibers (0.7 dpf, 0.78 dtex, 1.5 inch cut, 12 cpi, without any special slickening finish) and 15 pounds of binder fiber. These samples were resin-sprayed, calendered and tested as for samples E and F.

Samples K and L were prepared from a blend of about 55 pounds of similar 0.7 dpf slick fiber, finished with a silicone slickener, 27 pounds of dry (unslickened) 0.7 dpf fiber, and 18 pounds of binder fiber. These samples were not calendered, as indicated by the double asterisks in Table 3, but gave good sealing ratings.

Samples M, O, P and Q were similarly prepared from the same kind of blend as K and L, but were made to higher basis weights, as shown, and also showed good sealing ratings, despite lower (less than 10%) resin add-on and despite not being calendered, because of use of low dpf fiber. N was calendered (unlike the others). A comparison of these results shows that calendering was not needed to improve the sealing rating. (when the subdenier fibers were used with the soft resin).

Samples G through L were all tested for fiber leakage using the 48 Frazier fabric.

Accordingly, in Table 3, samples D, F thru I and K thru Q are all according to the invention, whereas A, E and J show comparisons (without any resin sprayed on) and B and C also show comparisons (with regular denier fiberfill) whose sealing ratings are not adequate after washing.

TABLE 3

| | FRAZIER | BW | FIBER DPF | RESIN % | RESIN * | SEALING RATINGS NEW | 1 W | 3 W |
|---|---|---|---|---|---|---|---|---|
| A | 13.2 | 4.5 | 1.65 | 0 | 0 | 5 | 1 | 1 |
| B | 13.2 | 4.5 | 1.65 | 8 | 0.36 | 5 | 1 | 1 |
| C | 13.2 | 4.5 | 1.65 | 15 | 0.67 | 5 | 3 | 1 |
| D | 13.2 | 4.5 | 1.65 | 25 | 1.125 | 5 | 5 | 5 |
| E | 48 | 4.5 | 1.65 | 0 | 0 | 1 | 1 | 4 |
| F | 48 | 4.5 | 1.65 | 25 | 1.125 | 5 | 5 | 5 |
| G | 48 | 4.5 | 0.7 | 4 | 0.18 | 5 | 5 | 5 |
| H | 48 | 4.5 | 0.7 | 2.2 | 0.10 | 5 | 5 | 5 |
| I | 48 | 4.5 | 0.7 | 1.6 | 0.07 | 5 | 5 | 5 |
| J | 48 | 4.5 | 0.7 | 0 | 0 | 4 | 1 | 1 |
| K** | 48 | 4.5 | 0.7 | 10 | 0.45 | 5 | 5 | 5 |
| L** | 48 | 4.5 | 0.7 | 5 | 0.225 | 5 | 5 | 5 |
| M** | 48 | 6.1 | 0.7 | 6 | 0.37 | 5 | 5 | 4 |
| N | 48 | 5.1 | 0.7 | 7 | 0.36 | 5 | 5 | 5 |
| O** | 48 | 8.0 | 0.7 | 6 | 0.48 | 5 | 5 | 5 |
| P** | 48 | 8.1 | 0.7 | 8 | 0.65 | 5 | 5 | 5 |
| Q** | 48 | 9.3 | 0.7 | 5 | 0.47 | 5 | 5 | 5 |

*indicates the total amount of resin sprayed on (both surfaces of) the batt, calculated in oz/yd² (half these amounts indicate the amounts on each face).
**indicates there was no calendering after oven cure Example 4

In the following Table 4 are reported the properties of other batts of the invention, prepared by the apparatus and process essentially as described in Example 2, above, using the same oven and roll temperatures and times as in Examples 1 and 2, but a different latex. The latex used for this Example 4 was Rohm and Haas' Rhoplex ST-954, having a glass transition (Tg) temperature of −23° C. "Fiber A" was the same fiber blend as that used in Example 1; the binder fiber ("Melty 4080") had already been combined with the fiberfill. The batts in this Example provided good WD, SR and low bending stiffness (i.e., were desirably soft) as described according to the invention; they tended to become slightly sticky (which can tend to make them more difficult to cut and sew during garment manufacturing, because of the lower Tg, –23° C. of the latex) We believe that a latex with an even lower Tg (less than –30° C.) would generally tend to cause even more stickiness, and so would be even less desirable for normal operation.

TABLE 4

| BATTING | | | | BASIS | | | | | | |
|---|---|---|---|---|---|---|---|---|---|---|
| ITEM | | % | % | WEIGHT | THICKNESS | | | B | | |
| NO. | FIBER | BINDER | RESIN | (OZ/YD$^2$) | (INCHES) | WD | SR | MD | CD | TOTAL |
| 6 | A | 18 | 18 | 2.41 | 0.41 | 4 | 5 | 24.6 | 29.5 | 54.1 |
| 7 | A | 18 | 18 | 4.37 | 0.49 | 4 | 5 | 15.3 | 18.9 | 34.2 |

What we claim is:

1. A bonded batt with upper and lower faces, said batt comprising polyester fiberfill of 0.2 to 10 dtex per filament, in an amount of about 75 to 98%, and bonded throughout with lower melting binder material, in an amount of about 2 to 25%, said amounts being calculated on the basis weight of the batt, said upper and lower faces of said batt being sealed with a resin having a glass transition temperature (Tg) in the range of about 0 degrees to –30 degrees Celsius, in an amount of about 10 to 30% of the total weight of the batt, whereby the sealing rating (SR, as defined) after 3 wash cycles of said faces is at least 4, said batt having a wash durability (WD, as defined) of at least 3, and a bending stiffness (B, as defined) of about 80 cN/cm$^2$ or less.

2. A batt according to claim 1, wherein the bending stiffness is about 50 cN/cm$^2$ or less.

3. A bonded batt with upper and lower faces, said batt comprising polyester fiberfill of 0.2 to 10 dtex per filament, in an amount of about 75 to 98%, and bonded throughout with lower melting binder material, in an amount of about 2 to 25%, said amounts being calculated on the basis weight of the batt, said batt having a wash durability (WD, as defined) of at least 3, and a bending stiffness (B, as defined) of about 80 cN/cm$^2$ or less, wherein at least one of said faces is sealed with a rosin having a glass transition temperature (Tg) in the range of about 0 degrees to –30 degrees Celsius, in an amount of about 5 to 15% of the total weight of the batt, whereby the sealing rating (SR, as defined) after 3 wash cycles of said face is at least 4.

4. A batt according to claim 3, wherein the bending stiffness is about 50 cN/cm$^2$ or less.

5. A bonded bait with upper and lower faces, said bait comprising polyester fiberfill of dealer per filament about 1 or less, in an amount of about 75 to 96%, and bonded throughout with lower melting binder material, in an amount of about 4 to 25%, said amounts being calculated on the basis weight of the batt, said batt having a wash durability (WD, as defined) of at least 4, and a bending stiffness (B, as defined) of about 40 cN/cm$^2$ or less, wherein at least one of said faces is sealed with a resin having a glass transition temperature (Tg) in the range of about 0 degrees to –30 degrees Celsius, in amount about 0.02 oz/yd$^2$ to about 0.35 oz/yd$^2$, calculated with regard to said face of the batt, whereby the sealing rating (SR, as defined) after 3 wash cycles of said face is at least 4.

6. A batt according to claim 5, wherein the amount of resin is about 0.1 to about 0.25 oz/yd$^2$.

7. A batt according to claim 5, wherein each of said upper and lower faces is sealed with said resin in said amount and has a sealing rating after 3 wash cycles of at least 4.

8. A batt according to claim 6, wherein each of said upper and lower faces is sealed with said resin in said amount and has a sealing rating after 3 wash cycles of at least 4.

* * * * *

UNITED STATES PATENT AND TRADEMARK OFFICE

CERTIFICATE OF CORRECTION

PATENT NO. : 5,527,600

DATED : June 18, 1996

INVENTOR(S) : Michael S. Frankosky; Wo K. Kwok

It is certified that error appears in the above-indentified patent and that said Letters Patent is hereby corrected as shown below:

Col. 12, line 3,

In Claim 3, line 9, "rosin" is hereby deleted and -- resin -- is inserted in place thereof.

Col. 12, line 10,

In Claim 5, line 1, "bait" is hereby deleted and -- batt -- is inserted in place thereof.

Col. 12, line 11,

In Claim 5, line 2, "dealer" is hereby deleted and -- denier -- is inserted in place thereof.

Signed and Sealed this

Seventh Day of January, 1997

*Attest:*

*Attesting Officer*

BRUCE LEHMAN

*Commissioner of Patents and Trademarks*